United States Patent [19]

Arbetter

[11] Patent Number: 4,650,102

[45] Date of Patent: Mar. 17, 1987

[54] APPARATUS FOR FORMING APERTURES IN PLEATS

[75] Inventor: Michael Arbetter, Greensburg, Pa.

[73] Assignee: Crown Creative Industries, Inc., Greensburg, Pa.

[21] Appl. No.: 819,055

[22] Filed: Jan. 15, 1986

[51] Int. Cl.[4] ..... A41H 43/00

[52] U.S. Cl. ..... 223/28; 223/34

[58] Field of Search ..... 223/28, 30, 31, 34, 223/35; 362/358, 320, 356; 83/901, 925 CC, 95, 86; 234/1, 49, 128

[56] References Cited

U.S. PATENT DOCUMENTS

| | | | |
|---|---|---|---|
| 1,124,360 | 1/1915 | Tholl | 83/95 |
| 2,122,971 | 7/1938 | Angeletti | 362/358 |
| 2,319,766 | 5/1943 | Cox et al. | 83/95 |
| 2,558,196 | 6/1951 | Pinsuti | 223/28 |
| 2,677,993 | 5/1954 | Ens | 223/30 X |
| 2,714,155 | 7/1955 | Johnson | 362/356 X |
| 3,656,686 | 4/1972 | Lee et al. | 234/1 |
| 4,057,178 | 11/1977 | Martin | 223/35 |

*Primary Examiner*—Louis K. Rimrodt
*Attorney, Agent, or Firm*—Epstein & Edell

[57] ABSTRACT

In a pleat forming machine, apertures are defined in a pleat simultaneously with the formation of the pleat. A pusher bar carries a cutting member which projects into a recess defined in a pleating bar when the two bars are brought together to form the pleat. By so projecting, the cutting member pierces the folded material between the bars to form the required apertures. Clean and accurate cutting is assured by providing a continuous cutting edge, at the distal end of the cutting member, biased at an angle relative to the mating surfaces of the bars in order to concentrate the cutting force at a small portion of the edge at the time of puncture.

10 Claims, 4 Drawing Figures

APPARATUS FOR FORMING APERTURES IN PLEATS

BACKGROUND OF THE INVENTION

1. Technical Field

The present invention relates to automatic pleating machines and, more particularly, to a method and apparatus for forming apertures or holes in an accordion pleating machine. Although the end product produced by the method and apparatus has particular utilization in the fabrication of pleated lamp shades, other uses are certainly within the contemplation of the invention.

2. Discussion of the Prior Art

Automatic pleating machines employed in the prior art utilize a pusher bar in cooperation with a pleating or reefer bar to form a continuum of accordion pleats in a moving web of material. Such machines are manufactured and sold by: Mutual Manufacturing Company, Inc., of New York, N.Y. ("Rugged Accordion Pleating Machine"); Karl Rabofsky GmbH, of West Berlin, Germany ("RABO 88 Accordion Pleating Machine"); and Enguda Industrial Company, Ltd., of Taipei, Taiwan (Model C-67). Such machines are generally also described and illustrated in U.S. Pat. No. 2,677,993. Generally, in such machines, the pleating or reefer bar reciprocates along a path extending perpendicular to the moving web of material while the pusher bar reciprocates along a path extending generally parallel to the moving web, toward and away from the reciprocating pleating bar. The pleats are formed by compressing respective sections of the web material between the two bars during each reciprocation cycle of the bars.

For some pleated products, such as pleated lamp shades, it is necessary to provide holes or apertures in the pleats in order for a cord, wire or frame to be inserted through the apertures to properly contour the final lamp shade product. For example, such lamp shade products may be found in U.S. Pat. No. 2,122,971 (Angeletti), No. 1,570,230 (Chambers), and No. 2,714,155 (Johnson). It is conventional to form such holes or apertures with punches operated in synchronization with the motion of the web of material in order to provide spaced apertures along the length of the web. Spacing between the apertures is selected such that they are aligned in successive pleats formed downstream of the punch. Unfortunately, the apertures do not always register properly and considerable amounts of pleated material must be discarded. Reasons for the absence of registry include improper design or assembly, wearing of parts due to use, changes in synchronization control parameters, etc. Whatever the reason, improper registration of the apertures is wasteful and costly.

OBJECTS AND SUMMARY OF THE INVENTION

It is therefore an object of the present invention to provide an improved method and apparatus for forming apertures in pleated material.

It is another object of the present invention to provide a method and apparatus for forming apertures and pleats in a web of material as part of a continuous process in which the registration of apertures in each pleat and in adjacent pleats is automatically assured.

A further object of the present invention is to assure registration of apertures in both sides of a pleat and between successive pleats during a pleat forming process.

In accordance with the present invention apertures are formed in each pleat simultaneously with the formation of the pleat to assure proper orientation of the apertures in each pleat. To accomplish this, one of the pusher and pleating bars is provided with a projecting punch while the other is provided with a recess or slot positioned to receive the punch when the bars come together to form a pleat. In the preferred embodiment of the invention the pusher bar carries the projecting punch while the pleating bar has the mating recess defined therein. As the pleating is being formed between the two bars, the projecting punch projects through both sides of the pleated material and into the recess of the pleating bar to form an aperture in each side of the pleat. The punch is preferably a hollow member having a sharp continuous projecting cutting edge which cuts the material to form the apertures. The cut material is received inside the hollow punch and is carried away, through the punch, by means of a vacuum line connected to the hollow punch interior. The cutting edge is preferably oval or elliptical in shape and is slanted relative to the mating plane of the pleating bar to assure a smooth puncture and cutting action during the respective reciprocating motions of the two bars.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DESCRIPTION OF THE PREFERRED EMBODIMENT

Figure 1:
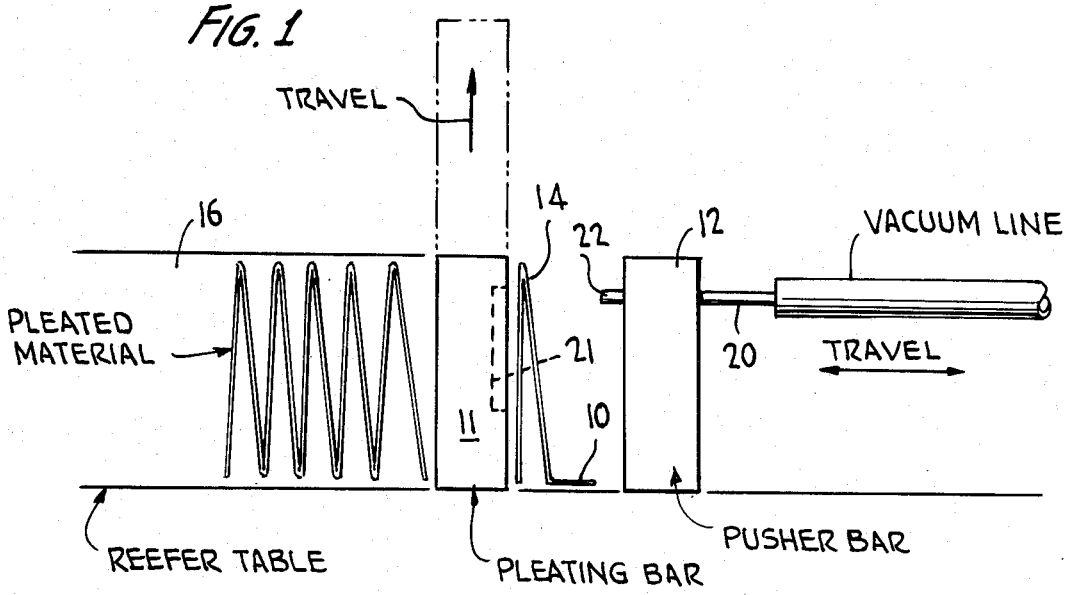
FIG. 1 is a schematic diagram of the method and apparatus for forming apertures in pleats according to the present invention.
Figure 2:
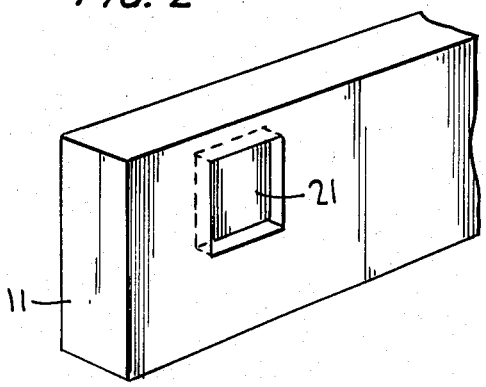
FIG. 2 is a view in perspective of the pleating bar used in the apparatus of FIG. 1.
Figure 3:
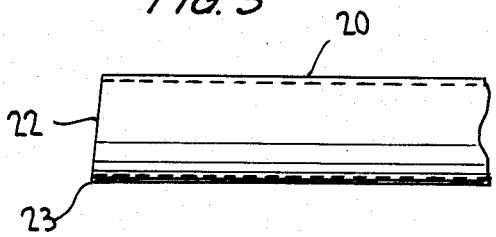
FIG. 3 is a side view in elevation of the punch utilized in the apparatus illustrated in FIG. 1.

Referring to the accompanying drawings in greater detail, the illustrated components are part of an automatic pleating machine. Only those components necessary to illustrate the present invention are shown, it being understood that the remainder of the machine is conventional and in wide commercial use. A web 10 of material to be pleated is translated from right to left, as viewed in FIG. 1. A pleating or reefer bar 11 reciprocates between extreme pleating (shown in solid lines) and remote (shown in dashed lines) positions in a direction generally perpendicular to the direction of web motion. A pusher bar 12, disposed upstream of the pleating bar (relative to web movement), reciprocates between spaced and adjacent positions (relative to the pleating bar 11) in a direction parallel to web movement. The reciprocating motions of pleating bar 11 and pusher bar 12 are synchronized such that the two bars abut one another when the pleating bar is in its pleating position and the pusher bar is in its adjacent position. When the two bars so abut, a section of material from web 10 is disposed between the two bars and is folded into a pleat 14. After each pleat 14 is formed, pleating bar 11 is moved to its remote position, permitting the just-formed pleat to pass to a reefer table 16 where the pleated material is collected.

The components and operation described in the preceding paragraph are conventional. In accordance with the present invention, one of the pleating bar 11 and pusher bar 12 is provided with a projecting punch or cutting member 20 while the other bar is provided with a corresponding recess or slot 21. In the preferred embodiment of the invention the cutting member 20 is provided on the pusher bar 12 and projects from the surface of the pusher bar which faces and abuts the pleating bar in the adjacent pusher bar position. Recess 21 is defined in the surface of pleating bar 11 which faces and abuts pusher bar 12 in the pleating position. The cutting member 20 and recess 21 are oriented such that the cutting member projects into the recess when the two bars abut during formation of pleat 14. Consequently, the leading or cutting edge 22 of the cutting member projects through both sides of the pleat 14 and into the recess as the pleat is being formed. In the preferred embodiment of the present invention, cutting member 20 is a hollow tube projecting generally parallel to the direction of motion of web 10. Leading edge 22 of the cutting member 20 is a continuous sharp edge to permit accurate cutting of the web material to form the required apertures. The hollow interior of the cutting member 20 is connected to a vacuum source so that the cut material can be drawn away from the pleat through the cutting member to a waste collection facility. In order to facilitate entry of the leading edge 22 into the cutting member through the web material, the leading edge is cut on a bias or angle (typically on the order of 10 degrees) relative to the plane perpendicular to the longitudinal axis of the tubular cutting member. The angled leading edge permits the sharp forwardmost section 23 of cutting edge to first contact the web material so that the force behind the pusher plate is concentrated at section 23. This provides for a high pressure applied to the web material, thereby facilitating puncture or piercing of the material by the cutting member.

Recess 21 encompasses a considerably larger area than does cutting edge 22 to assure that the cutting member projects into the recess in spite of relative movement between pleating bar 11 and pusher bar 12. More particularly, the pleat-forming operation is usually conducted continuously, at high speed, so that some slight relative movement between the two facing surfaces of the bars is to be expected at the instant of aperture formation. By enlarging the recess 21 relative to cutting edge 22, the cutting member remains within the recess whenever the pleating and pusher bars are proximate one another. This prevents damage to the cutting member 20 and assures formation of cleanly cut apertures. In the preferred embodiment of the present invention the recess 21 is at least twice as large in length and width than the corresponding dimensions of the cutting edge 22.

Figure 4:
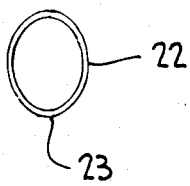
FIG. 4 is a front view in elevation of the cutting edge of the punch illustrated in FIG. 3.

The oval configuration of cutting edge 22 illustrated in FIG. 4 is provided to achieve oval apertures in the final pleated product. The cutting edge can have virtually any configuration (i.e., circular, polygonal, etc.), regularly or irregularly shaped, depending upon the shape of the desired aperture.

The illustrated embodiment is designed to provide a single pair of apertures in a single pleat, formed as the pleat is being formed. It is, of course, possible to provide additional sets of cutting members and recesses in the pleating and pusher bars to simultaneously form additional apertures in the pleat, as it is being formed, if the end product requires additional apertures. It is also possible to simultaneously run a plurality of webs 10 in edge-to-edge parallel relation through a pleating bar and pusher bar provided with cutting members and recess arrangements for each web.

I have disclosed an improved method and apparatus for providing apertures in pleated material as part of the pleating process and in a manner which assures alignment and registration of the apertures in each pleat and in successive pleats. This is achieved by forming the apertures simultaneously with and by the same mechanism as the formation of the pleat in which the apertures are formed.

Having described a preferred embodiment of a new and improved method and apparatus for forming apertures in pleated material in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined in the appended claims.

I claim:

1. In a pleat forming machine of the type in which individual pleats are successively formed in a web of material, said machine comprising:

a movable pleating bar having a first surface;

a movable pusher bar having a second surface;

means for repeatedly reciprocating said pleating bar and pusher bar into close and then remote proximity with one another to compress successive sections of said web of material between said first and second surfaces when the bars are in close proximity to thereby form individual pleats one at a time in successive sections, respectively of said web;

aperture-forming means for forming an aperture in each pleat simultaneously with the formation of that pleat, said aperture-forming means comprising;

a cutting member projecting from one of said first and second surfaces toward the other of said first and second surfaces; and a recess defined in the other of said first and second surfaces at a location in registration with said cutting member when said bars are in close proximity to permit the cutting member to project through an interposed section of said web and into said recess as a pleat is being formed in the interposed section.

2. The apparatus according to claim 1 wherein said cutting member has a continuous cutting edge at its distal end, and wherein said recess encompasses an area which is larger than the area encompassed by said cutting edge.

3. The apparatus according to claim 2 wherein the recess has length and width dimensions which are at least twice as large as corresponding dimensions of said cutting edge.

4. The apparatus according to claim 1 wherein said cutting member is an elongated member having a distal continuous cutting edge residing in a plane disposed at a small angle relative to a plane perpendicular to the longitudinal axis of said elongated member.

5. In a pleat forming machine of the type having a movable pleating bar and movable pusher bar which are brought into adjacency to form a pleat in material disposed between facing surfaces of the bars, apparatus for forming apertures in said pleat comprising:

a cutting member projecting from the facing surface of one of said bars toward the facing surface of the other of said bars; and a recess defined in the facing surface of the other of said bars at a location in registration with said cutting member when said bars are brought into adjacency to permit the cutting member to project through said pleat and into said recess;

wherein said cutting member is an elongated member having a distal continuous cutting edge residing in a plane disposed at a axis of said elongated member;

wherein said elongated member is hollow, said apparatus further comprising means for drawing cut portions of said pleat through said hollow elongated member.

6. The apparatus according to claim 1 wherein said pleating bar reciprocates in a path substantially parallel to said first and second surfaces, wherein said pusher bar reciprocates in a path substantially perpendicular to said first and second surfaces, and wherein said cutting member projects substantially perpendicular to said first and second surfaces.

7. In a pleat forming machine of the type having a movable pleating bar and movable pusher bar which are brought into adjacency to form a pleat in material disposed between facing surfaces of the bars, apparatus for forming apertures in said pleat comprising:

a cutting member projecting from the facing surface of one of said bars toward the facing surface of the other of said bars; and a recess defined in the facing surface of the other of said bars at a location in registration with said cutting member when said bars are brought into adjacency to permit the cutting said bars are brought into adjacency to permit the cutting member to project through said pleat and into said recess;

wherein said cutting member has a continuous cutting edge at its distal end, and wherein said recess encompasses an area which is larger than the area encompassed by said cutting edge; and, wherein said cutting member is an elongated hollow member, said apparatus further comprising means for drawing cut portions of said pleat through said hollow member for disposal.

8. The apparatus according to claim 7 wherein said cutting edge resides in a plane which is at a small angle relative to a plane perpendicular to the longitudinal axis of said tubular member.

9. A pleating machine for forming a series of individual pleats in a web of material, said machine comprising:

movable means for forming said individual pleats sequentially in time and sequentially in space along said web, each pleat having at least one fold line and two sides; and aperture-forming means for forming an aperture in both sides of said each pleat simultaneously with the formation of said each pleat by said movable means.

10. The pleating machine according to claim 9 wherein said movable means comprises two mutually displaceable members arranged to reciprocate toward and away from another, the two members being in closest mutual proximity at the time of formation of said each pleat; and wherein said aperture-forming means comprises a cutting member projecting from one of said two members and a recess defined in the other of said two members, said cutting member being oriented to be received in said recess after projecting through both sides of said each pleat when the two members are in closest mutual proximity.

* * * * *